US010774604B2

(12) United States Patent
Fuglestad

(10) Patent No.: US 10,774,604 B2
(45) Date of Patent: Sep. 15, 2020

(54) SLICK LINE, FIBER OPTIC CABLE OR TUBING WELLBORE PULLING TOOL AND PROPULSION MODULE

(71) Applicant: Well Conveyor AS, Bryne (NO)

(72) Inventor: Kenneth Fuglestad, Bryne (NO)

(73) Assignee: WELL CONVEYOR AS, Bryne (NO)

( * ) Notice: Subject to any disclaimer, the term of this patent is extended or adjusted under 35 U.S.C. 154(b) by 134 days.

(21) Appl. No.: 16/068,561

(22) PCT Filed: Jan. 9, 2017

(86) PCT No.: PCT/NO2017/050006

§ 371 (c)(1),
(2) Date: Jul. 6, 2018

(87) PCT Pub. No.: WO2017/119823

PCT Pub. Date: Jul. 13, 2017

(65) Prior Publication Data

US 2019/0040698 A1 Feb. 7, 2019

(30) Foreign Application Priority Data

Jan. 8, 2016 (NO) ..... 20160042

(51) Int. Cl.

| | |
|---|---|
| ***E21B 23/14*** | (2006.01) |
| ***E21B 4/00*** | (2006.01) |
| ***E21B 4/18*** | (2006.01) |
| *E21B 23/00* | (2006.01) |

(52) U.S. Cl.

CPC ..... *E21B 23/14* (2013.01); *E21B 4/006* (2013.01); *E21B 4/18* (2013.01); *E21B 23/001* (2020.05)

(58) Field of Classification Search

CPC ..... E21B 23/14; E21B 4/006; E21B 4/18
See application file for complete search history.

(56) References Cited

U.S. PATENT DOCUMENTS 6,273,189 B1 * 8/2001 Gissler ..... E21B 4/04 166/241.1

FOREIGN PATENT DOCUMENTS

| | | |
|---|---|---|
| EP | 2 505 765 | 10/2012 |
| EP | 2 770 158 | 8/2014 |
| WO | 00/46481 | 8/2000 |
| WO | 2008/091157 | 7/2008 |
| WO | 2014/081305 | 5/2014 |

OTHER PUBLICATIONS

International Search Report dated Mar. 28, 2017 in corresponding International Application No. PCT/NO2017/050006.
Norwegian Search Report dated Jul. 25, 2016 in corresponding Norwegian Application No. 20160042.

* cited by examiner

*Primary Examiner* — D. Andrews
(74) *Attorney, Agent, or Firm* — Wenderoth, Lind & Ponack, L.L.P.

(57) ABSTRACT

A slick line, fiber optic cable, or tubing wellbore pulling tool includes a propulsion module having a main section and a hinged propulsion arm. A propulsion wheel with a gear system is supported in the propulsion arm. A gear system of the propulsion wheel includes an eccentric, internally toothed gear system with a fixed inner gear and a movable outer gear. The movable outer gear constitutes the propulsion wheel. An electric motor is configured to drive the propulsion wheel via the gear system.

15 Claims, 8 Drawing Sheets

SLICK LINE, FIBER OPTIC CABLE OR TUBING WELLBORE PULLING TOOL AND PROPULSION MODULE

BACKGROUND OF THE INVENTION

1. Field of the Invention

The present invention relates to a pulling tool and to a propulsion module of a pulling tool used for pulling itself and other equipment into a wellbore or tubing.

2. Description of Related Art

Wellbores and tubing typically include long vertical and horizontal runs. In many wells there is a need for installing a fiber optic cable to obtain real-time measurements of flow, pressure, and temperature, among other things. In itself, a fiber optic cable is very thin and weak. Therefore, several types of claddings are used for protecting the fiber optic cable such as metal, Kevlar, or carbon rods. Common to all these cables are that they are very lightweight and a bit flexible, which present some challenges when they are to be installed in horizontal wells.

Since a fiber optic cable is a signal cable only, most pulling tools need to be battery operated. Therefore, it is essential that the pulling tool is as efficient and lightweight as possible to limit the necessary power consumption. Currently, no pulling tool exists that is specially designed for these applications.

In addition to fiber optic cable installation, there is also a need for a pulling tool for performing light slick line well interventions. Similarly to a fiber optic cable, the same challenges are encountered when a slick line is run into horizontal wells. Due to the limited rigidity of the slick line, it is not possible to push it very far into horizontal wells. In order to be able to perform light well interventions by way of slick line in horizontal wells, a battery operated pulling tool is needed.

Wells in which there is a need for running light well interventions have small internal diameters and have nipple profiles as small as 40 mm. Therefore, it is necessary to construct the pulling tool small enough to be able to pass through the smallest nipple profiles. To enable this, known gearing solutions are used in a new manner herein. The diameter of the well may be larger than the combined diameters of the pulling tool and the cable to be pulled by the pulling tool.

Several variants of pulling tools or well tractors are available in the market. A known solution includes an electric motor driving a hydraulic pump which in turn drives a hydraulic motor of the propulsion wheel. Such a system is technically complex and not very efficient. Other variants available use an electric motor that translates the rotation directly by way of an angular gear and on to the wheel either by way of chain/belt drive or straight gears. Such systems present a challenge in that the gear ratio is not high enough to allow the use a high efficiency, brushless permanent magnet motor operating at a relatively high revolutions per minute (RPM). It is known to include a planetary gear in the propulsion wheel itself, of which the moving outer gear constitutes the propulsion wheel of the pulling tool, in order to reduce the rotational speed between the motor and the propulsion wheel. However, there is a limitation on how small a planetary gear can be made since such a gear includes a number of components located inside each other, each of which needs to resist the torque applied. Also, the achievable gear ratio is relatively low.

SUMMARY OF THE INVENTION

Through the present invention a robust and efficient gear system having a higher gear ratio than those of existing systems is obtained. In general, smaller diameter motors operate at a higher RPM and it is therefore desirable to have a higher gear ratio between the motor and the propulsion wheel. By this invention, a higher gear ratio is obtained in a more compact design, and consequently a higher gear ratio between the motor and the propulsion wheel is provided.

As compared to a planetary gear solution of the same size, this invention provides a gear ratio that is 5-10 times higher within the same dimensions.

Another object of the invention is to enable the construction of a pulling tool whose diameter is smaller than that of the pulling tools currently available in the market.

The present invention provides a small-sized, lightweight, high performance propulsion unit, which is preferably battery-operated.

The present invention discloses a slick line and/or fiber optic cable pulling wellbore and/or tubing pulling tool including a propulsion module having a main section. A propulsion arm is hinged to the main section, the propulsion arm having a propulsion wheel with a gear system. The gear system of the propulsion wheel comprises an eccentric, internally toothed gear system including a fixed inner gear and a moving outer gear. The moving outer gear includes the internal toothing and constitutes the propulsion wheel of the pulling tool. An electric motor for driving the propulsion wheel via the gear system is located in the hinged propulsion arm.

A "slick line", as the term is used herein, may also include an electric cable.

In the present invention, a high efficiency, high RPM, low torque, submergible brushless motor can be used which exhibits good moisture resistance and wear resistance and that does not lose power and efficiency over time. This is enabled through the use of a gear system in the propulsion wheel, which gear system includes an eccentric, internally toothed gear system in the form of a hypocycloid gear, or a cycloid gear exhibiting a rated transformer ratio and an output torque that is significantly larger than what can be achieved with a planetary gear of the same size.

The pulling tool may further comprise a cable transition, a battery module including one or more batteries for operating the electric motor, an electronics module, and at least two propulsion modules.

The pulling tool may further comprise four propulsion modules and a nose connection.

The electric motor may comprise a rotor having an anchor with an output shaft and a pinion fixed to the output shaft.

The electric motor may be a brushless motor having a longitudinal axis perpendicular to an axis of rotation of the propulsion wheel, and the pulling tool may further comprise a brushless motor controller.

An electric actuator can be provided between the main section and the hinged propulsion arm, with the hinged propulsion arm being configured for assuming a first, retracted position inside the propulsion module and a second, actuated position against a wellbore or tubing wall.

The pulling tool may have an external diameter of less than 40 mm.

The transmission ratio between the electric motor and the propulsion wheel can be greater than 1:50, and may be between 1:50 and 1:200 or higher so that a very low gearing can be achieved.

The eccentric, internally toothed gear system may be a cycloid gear.

The eccentric, internally toothed gear system may be a hypocycloid gear.

The invention further comprises a pulling tool propulsion module including a main section and a propulsion arm hinged to the main section, the propulsion arm having a propulsion wheel with a gear system. The gear system of the propulsion wheel comprises an eccentric, internally toothed gear system with a fixed inner gear and a moving outer gear exhibiting the internal toothing. The moving outer gear constitutes the propulsion wheel of the pulling tool. An electric motor drives the propulsion wheel through the gear system.

The electric motor may include a rotor with an anchor having an output shaft and a pinion fixed to the output shaft.

The electric motor may be a brushless motor having a longitudinal axis perpendicular to an axis of rotation of the propulsion wheel, with the pulling tool further including a brushless motor controller.

The transmission ratio between the electric motor and the propulsion wheel of the propulsion module can be greater than 1:50.

The eccentric, internally toothed gear system of the propulsion module may be a cycloid gear.

The eccentric, internally toothed gear system of the propulsion module may be a hypocycloid gear.

The present invention comprises a pulling tool having a tilting arm, a gear arrangement, and a wheel, in which an eccentric, internally toothed gear system is intended to include a cycloid gear, or hypocycloid gear with a fixed inner gear and a moving outer gear, which outer gear constitutes the propulsion wheel of the pulling tool. The eccentric, internally toothed gear system is not intended to include centric gear systems such as planetary gear systems.

A propulsion module for use in a wellbore, consisting of a main section and a propulsion arm including a propulsion wheel driven by a motor through a gear arrangement. The propulsion arm can be tilted from the main section by means of an electric motor or hydraulic piston action. The principle of the tilting arm is not described in this invention.

The gear arrangement between the motor and the wheel consists of an angular gear, straight gears, and the wheel itself.

A pulling tool includes at least one propulsion arm.

DETAILED DESCRIPTION OF THE INVENTION

Figure 1:
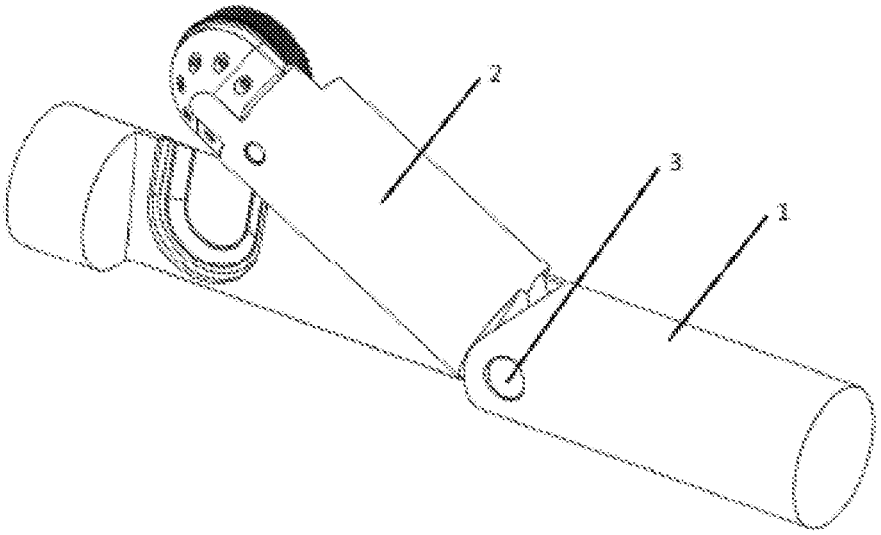
FIG. 1 is a perspective view of an embodiment of a propulsion module of a pulling assembly according to this invention.

The invention will now be explained in more detail using a cycloid gear, with reference to the drawings:

FIG. 1 is a perspective view of an embodiment of a pulling assembly according to the present invention. The pulling assembly includes a main section 1 supporting a complete propulsion arm 2. The complete propulsion arm 2 is connected to main section 1 via a hinge joint 3 by way of which the complete propulsion arm 2 can be tilted outwards.

Figure 2:
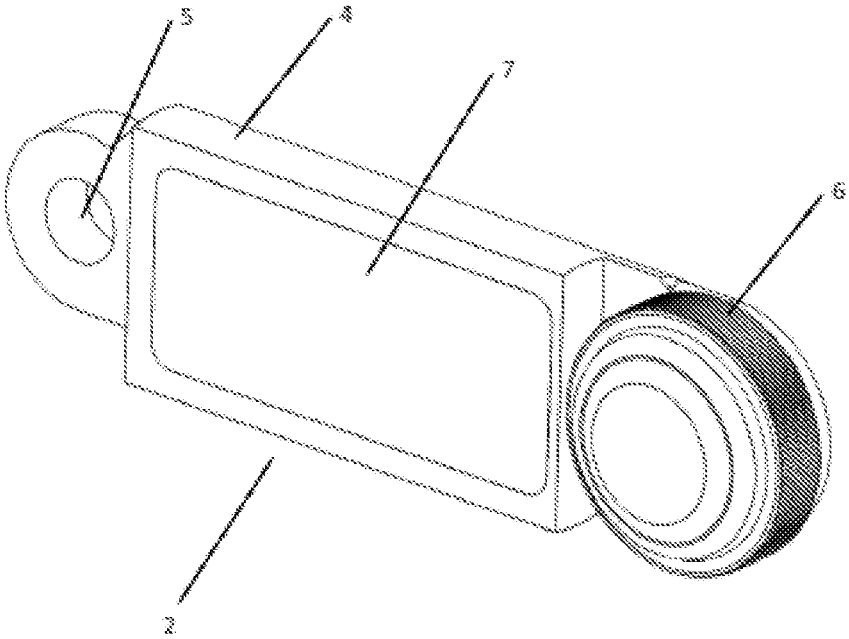
FIG. 2 is a perspective view of the propulsion arm.
Figure 3:
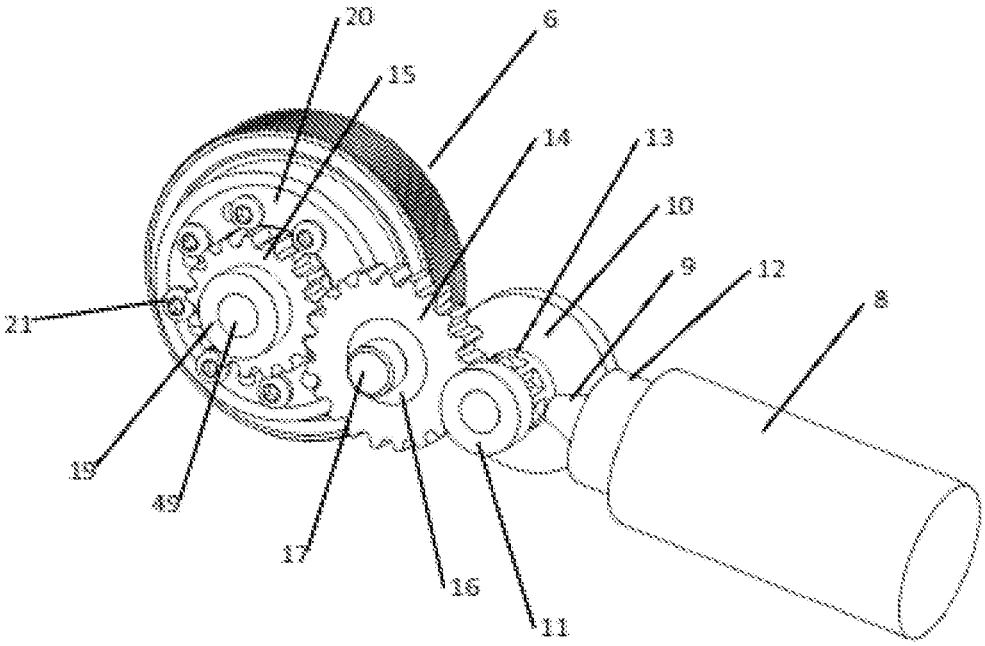
FIG. 3 shows the drive mechanism of the propulsion arm.

FIG. 2 shows the complete propulsion arm 2 comprising an arm body 4, a pivoting hole 5, the drive mechanism of FIG. 3, a complete propulsion wheel 6 and a cover 7.

FIG. 3 shows the drive mechanism comprising a motor 8, an angular gear which includes a pinion 9 fixed to the drive shaft of the motor, and a crown gear 10 supported in arm body 4 (shown in FIG. 2) by way of a bearing 11. Pinion 9 is supported in arm body 4 (shown in FIG. 2) by way of a bearing 12. Crown gear 10 is connected to a straight toothed wheel 13 connected to a straight toothed wheel 14, which is in turn connected to a straight toothed wheel 15 being part of the complete propulsion wheel 6.

The motor 8 rotates pinion 9 which transfers rotation to crown gear 10 which, through straight toothed wheel 13, transfers rotation to straight toothed wheel 14 which transfers rotation to straight toothed wheel 15 which transfers rotation to the complete propulsion wheel 6.

Toothed wheel 14 is supported by way of a bearing 16 supported on a shaft 17 attached to arm body 4 (shown in FIG. 2). Straight toothed wheel 15 includes a concentric shaft section 49 and is supported by way of a bearing 19 in arm body 4 (shown in FIG. 2).

The complete propulsion wheel 6 comprises a static component 20 fixed to arm body 4 (shown in FIG. 2) by fixing screws 21.

Figure 4:
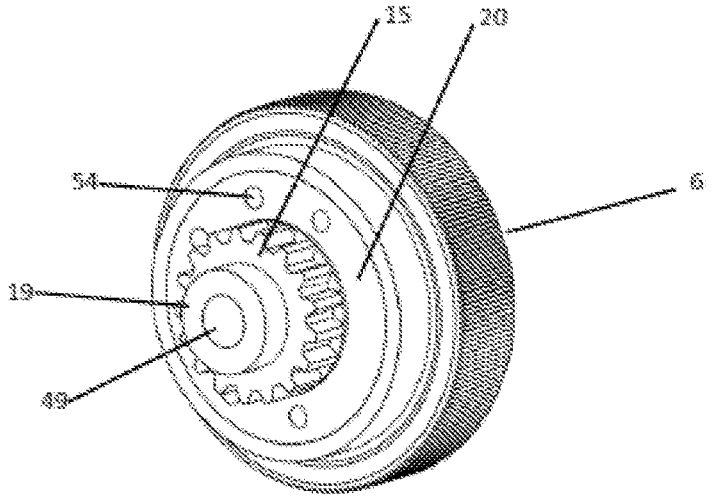
FIG. 4 shows the propulsion wheel.
Figure 5:
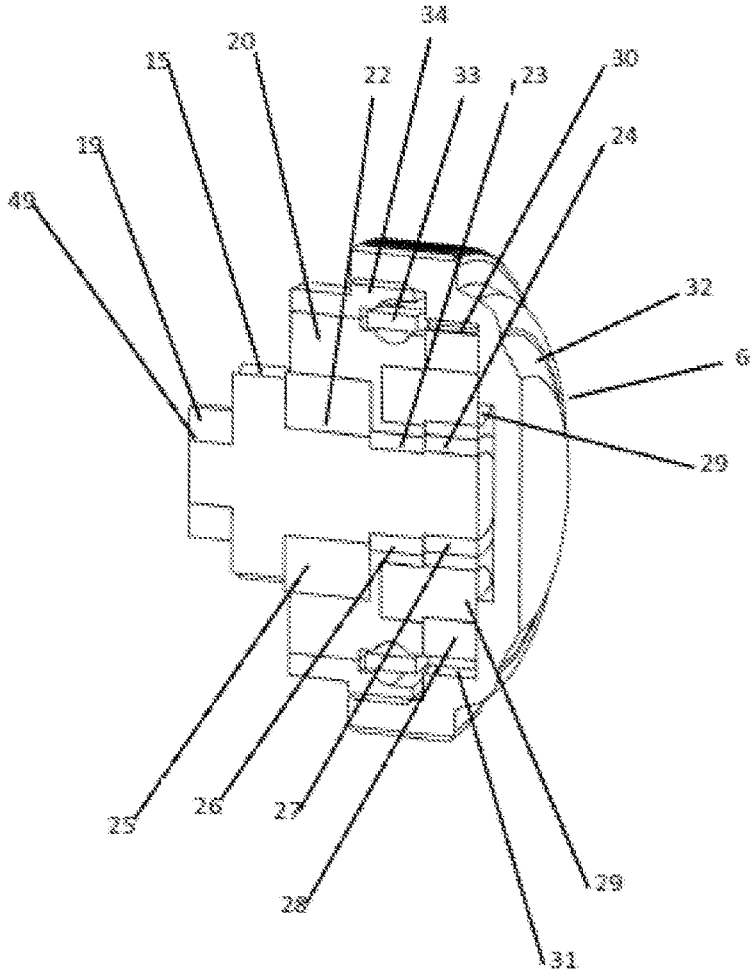
FIG. 5 shows the propulsion wheel with a cycloid gear in a sectional view.

FIGS. 4 and 5 show a complete propulsion wheel 6 comprising a straight toothed wheel 15 including a concentric shaft section 22, a concentric shaft section 23, a concentric shaft section 49, and an eccentric shaft section 24. Concentric shaft section 22 is supported by way of a bearing 25 of the static component 20. Concentric shaft section 23 is supported by way of a bearing 26 of static component 20. Eccentric shaft section 24 rotates via a bearing 27 moving the center axis of toothed wheel 28 about the center axis of concentric shaft sections 22 and 23. The center axis of toothed wheel 28 and eccentric shaft section 24 rotates about the center axis of concentric shafts 22 and 23. Toothed wheel 28 is prevented from rotating about its own center axis by eccentric roller pins 29 connected between toothed wheel 28 and static component 20. The external toothing 30 of toothed wheel 28 has fewer teeth than the internal toothing 31 of an outer propulsion wheel 32. Outer propulsion wheel 32 is supported by way of a bearing 33 of the static component 20 and connected by way of a mounting 34.

When toothed wheel 28 is moved eccentrically as the center axis thereof rotates about the center axis of concentric shafts 22 and 23, toothed wheel 28 will force outer wheel 32 to rotate by the meshing between toothing 30 and toothing 31. The gear ratio between toothed wheel 28 and outer propulsion wheel 32 equals the difference in number of teeth between toothings 30 and 31. If, for example, the number of teeth of wheel 30 is 49 and the number of teeth of wheel 31 is 50, then the gear ratio is (50–49)/50=1:50.

Toothed wheel 15 is supported by way of bearing 19 in arm body 4 (cf. FIG. 2). Static component 20 is fixed to arm body 4 (shown in FIG. 2) by way of fixing screws 21 (shown in FIG. 3) in threaded holes 54.

Figure 6:
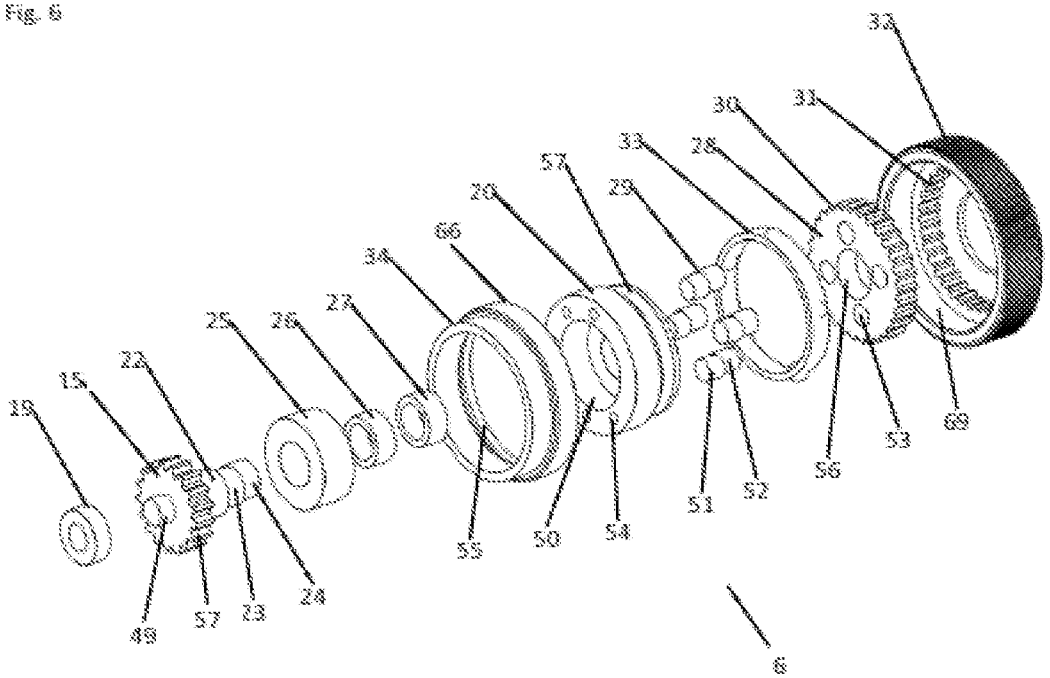
FIG. 6 shows the wheel with a cycloid gear with all parts in an exploded view.
Figure 7:
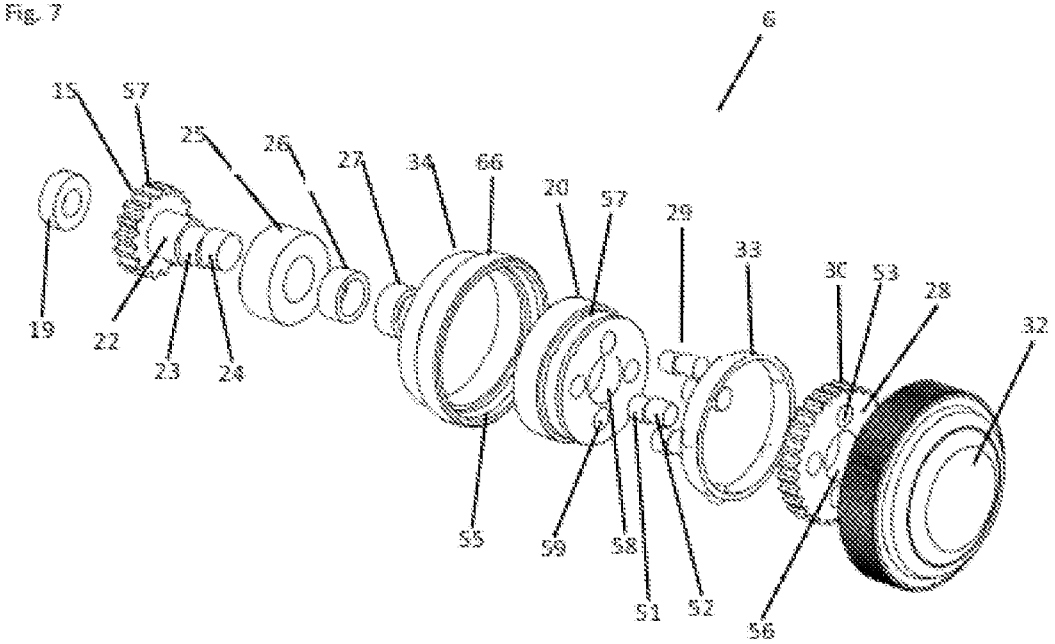
FIG. 7 shows the wheel with a cycloid gear with all parts in an exploded view.

FIGS. 6 and 7 are exploded views of the complete propulsion wheel 6. Toothed wheel 15 includes a gear rim with straight toothing 71, concentric shaft section 49, concentric shaft section 22, concentric shaft section 23, and eccentric shaft section 24. Bearing 19 is mounted to shaft section 49 and against arm body 4 (shown in FIG. 2). Bearing 25 is mounted to concentric shaft section 22 and in a housing raceway 50. Bearing 26 is mounted to concentric shaft section 23 and in a housing raceway 58. Bearing 27 is mounted to eccentric shaft section 24 and in a housing raceway 56. Bearing 33 is mounted to a bearing raceway 57 and a bearing raceway 55 is fitted over bearing 33. Eccentric roller pins 29 include a concentric shaft section 51 and an eccentric shaft section 52, the concentric shaft section 51 being mounted in a roller housing 59 and the eccentric shaft section 52 being mounted in a roller housing 53. Static component 20 is fixed in arm body 4 (shown in FIG. 2) by way of fixing screws 21 (shown in FIG. 3) in threaded holes 54. Toothed wheel 28 includes roller housing 53, housing raceway 56, and outer gear rim 30, meshing with internal gear rim 31. Outer propulsion wheel 32 includes internal toothing 31 and an internal thread 69. An external thread 66 is engaged with internal thread 69, thereby keeping outer propulsion wheel 32, toothed wheel 28, eccentric roller pins 29, static component 20, and mounting 34 together via bearing 33.

In another embodiment of the invention, a hypocycloid gear may be used.

In this embodiment, FIGS. 1, 2, 3, and 4 are as set forth in the above example using a cycloid gear. In this embodiment, FIGS. 5, 6, and 7 are replaced with FIGS. 8, 9, and 10, respectively.

Figure 8:
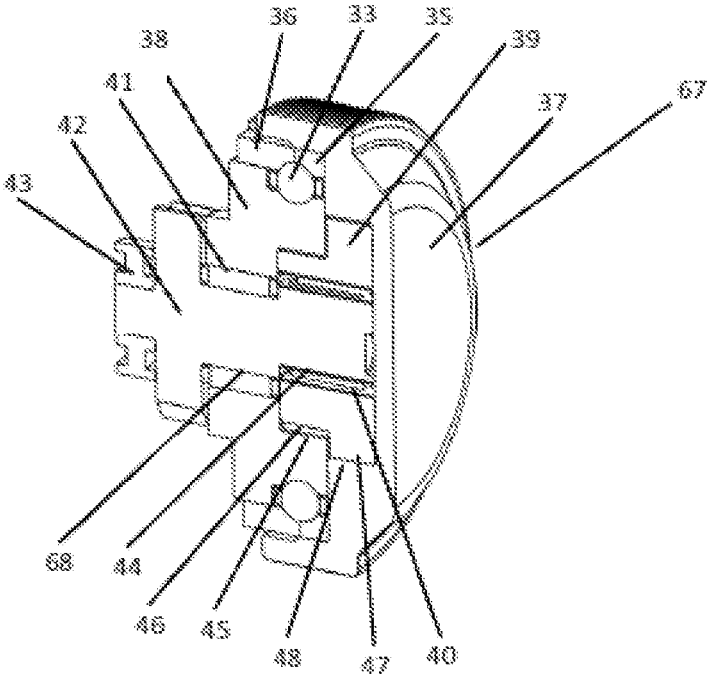
FIG. 8 shows the propulsion wheel with a hypocycloid gear in a sectional view.

FIG. 8 shows a complete propulsion wheel 67 including a straight toothed wheel 42 which includes a concentric shaft section 68 and an eccentric shaft section 44. Concentric shaft section 68 is supported by way of a bearing 41 of a static component 38. Eccentric shaft section 44 rotates via a bearing 40, moving the center axis of a double cycloid disk 39 about the center axis of concentric shaft section 68. Double cycloid disc 39 has a cycloid toothing 46 (also shown in FIGS. 9 and 10) and a cycloid toothing 47 (also shown in FIGS. 9 and 10). Cycloid toothing 46 moves in eccentric circles meshing with an internal cycloid toothing 45 (also shown in FIGS. 9 and 10) of static component 38. Cycloid toothing 47 moves in concentric circles meshing with an internal toothing 48 (also shown in FIGS. 9 and 10) of outer propulsion wheel 37.

The difference in number of teeth of cycloid toothing 46 relative to internal cycloid toothing 45 results in a gear ratio, so that double cycloid disc 39 rotates relative to the center axis of concentric shaft section 68. For example, if the number of teeth of cycloid toothing 46 is 7 and the number of teeth of internal cycloid toothing 45 is 8, then the gear ratio between static component 38 and double cycloid disc 39 is 1:7.

Similarly, the difference in number of teeth between cycloid toothing 47 and internal toothing 48 provides an additional gearing step for the rotation of outer propulsion wheel 37.

Propulsion wheel 37 is connected to static component 38 via an axial bearing 33 mounted between an angled bearing raceway section 35 and an angled bearing raceway 36 screwed to outer propulsion wheel 37.

Straight toothed wheel 42 is supported in arm body 4 (shown in FIG. 2) via a bearing 43.

Figure 9:
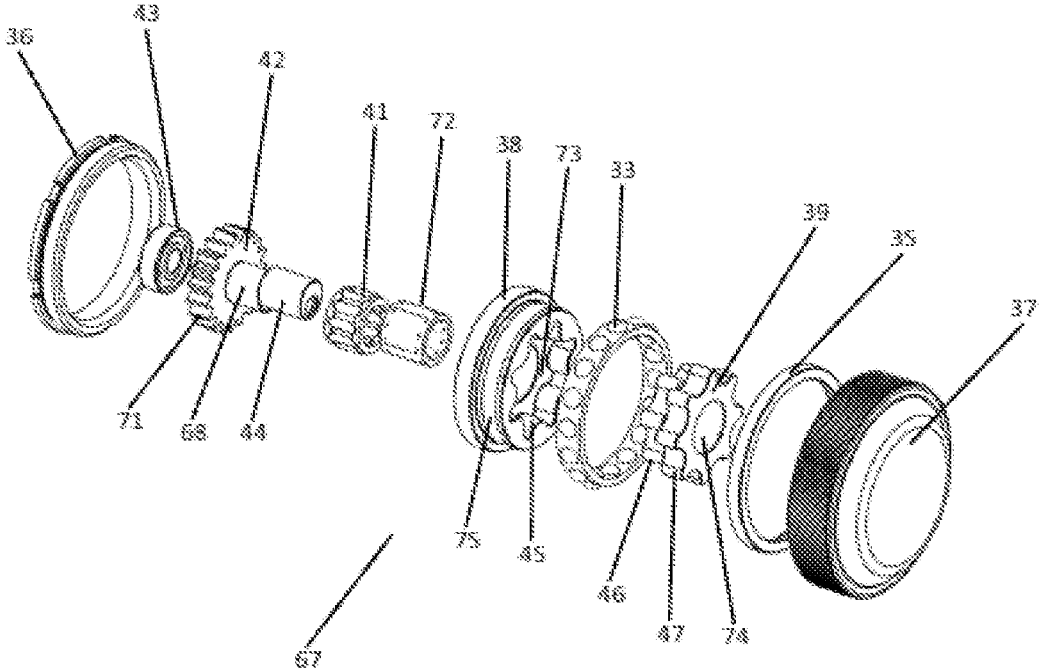
FIG. 9 shows the wheel with a hypocycloid gear with all parts in an exploded view.
Figure 10:
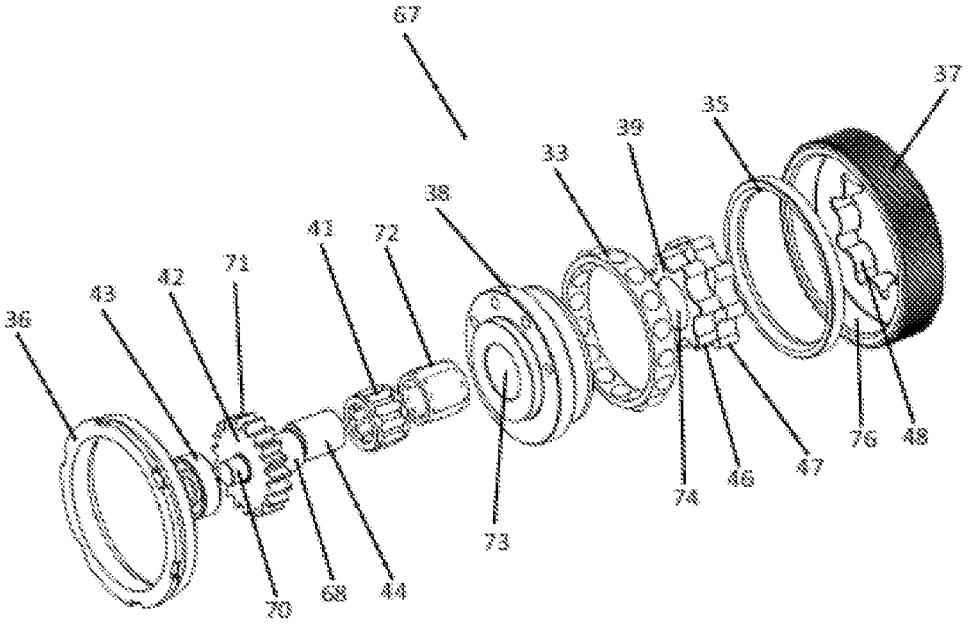
FIG. 10 shows the wheel with a hypocycloid gear with all parts in an exploded view.

FIGS. 9 and 10 are exploded views of the complete propulsion wheel 67. Toothed wheel 42 comprises a concentric shaft section 70, a gear rim with straight toothing 71, concentric shaft section 68 and eccentric shaft section 44. Concentric shaft section 70 is supported in arm body 4 (shown in FIG. 2) by bearing 43.

Bearing 41 is mounted to concentric shaft section 68 and in a housing 73. A bearing 72 is mounted to eccentric shaft section 44 and in housing 74. Double cycloid disc 39 is mounted in static component 38 so that outer cycloid toothing 46 meshes with inner cycloid toothing 45. Oppositely, outer cycloid toothing 47 is mounted so as to mesh with inner cycloid toothing 48 included by outer propulsion wheel 37. Axial bearing 33 is mounted on bearing raceway 75. Angled bearing raceway section 35 is mounted in internal housing 76. Bearing raceway 36 is mounted outside of axial bearing 33 and in internal housing 76.

Figure 11:
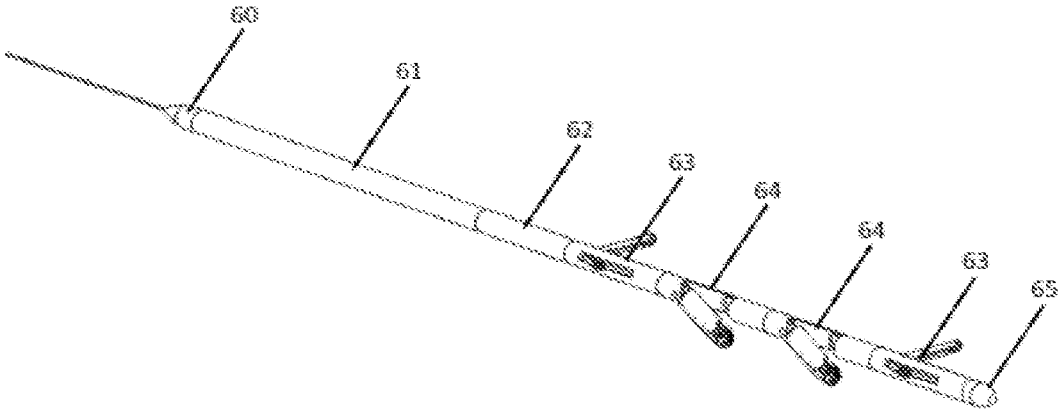
FIG. 11 shows an embodiment of a pulling tool with two propulsion modules and two centralization modules.
Figure 12:
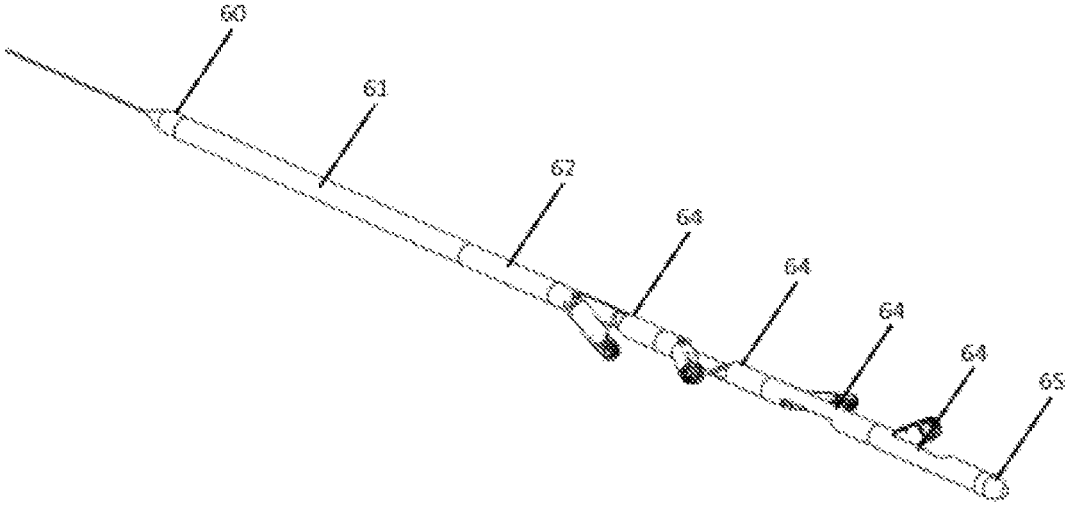
FIG. 12 shows an embodiment of a pulling tool with four propulsion modules.

FIGS. 11 and 12 show two pulling tools including two and four propulsion modules 64 according to the invention, respectively. The propulsion modules may include fasteners at each end for attaching a similar propulsion module or a different unit. The fasteners may comprise bayonet joints or threaded members. Each propulsion module may include a male fastening means at one end and a female fastening means at the other end, the male fastening means being configured for fitting attachment in the female fastening means. The fastening means may also include members or connectors for the transfer of power for operation and signalling.

FIG. 11 shows a battery-operated pulling tool comprising a cable transition 60, a battery module 61, an electronics module 62, two centralization modules 63, two propulsion modules 64 and a nose connection 65.

FIG. 12 shows a battery-operated pulling tool comprising a cable transition 60, a battery module 61, an electronics module 62, four propulsion modules 64, and a nose connection 65.

The invention claimed is:

1. A slick line, fiber optic cable, or tubing wellbore pulling tool comprising:

a propulsion module having a main section and a propulsion arm hinged to the main section, wherein:

the propulsion arm has a propulsion wheel with a gear system; and the gear system comprises an eccentric, internally toothed gear system including a shaft with an eccentric shaft section, a fixed inner gear and a movable outer gear, the movable outer gear exhibiting the internal toothing and constituting the propulsion wheel, and an electric motor for driving the propulsion wheel via the gear system.

2. The pulling tool of claim 1, further comprising:

a cable transition;

a battery module with one or more batteries for operating the electric motor; and an electronics module, wherein the propulsion module is one of at least two propulsion modules.

3. The pulling tool of claim 2, wherein:

the at least two propulsion modules include four propulsion modules; and the pulling tool further comprises a nose connection.

4. The pulling tool of claim 1, wherein the electric motor comprises a pinion.

5. The pulling tool of claim 1, wherein the electric motor is a brushless motor having a longitudinal axis perpendicular to an axis of rotation of the propulsion wheel.

6. The pulling tool of claim 1, wherein the pulling tool has an external diameter of less than 40 mm.

7. The pulling tool of claim 1, wherein a transmission ratio between the electric motor and the propulsion wheel is greater than 1:50.

8. The pulling tool of claim 1, wherein the eccentric, internally toothed gear system is a cycloid gear including:

a static component with roller housings;

a toothed wheel with roller housings; and eccentric roller pins extending into the roller housings of the static component and into the roller housings of the toothed wheel.

9. The pulling tool of claim 1, wherein the eccentric, internally toothed gear system is a hypocycloid gear including:

a static component with internal cycloid toothing, an outer propulsion wheel with internal cycloid toothing, and a double cycloid disc in the internal cycloid toothing of the static component and in the internal cycloid toothing of the outer propulsion wheel.

10. A propulsion module of a pulling tool, the propulsion module comprising:

a main sections; and a propulsion arm hinged to the main section, wherein:

the propulsion arm has a propulsion wheel with a gear system; and the gear system comprises an eccentric, internally toothed gear system including a shaft with an eccentric shaft section, a fixed inner gear and a movable outer gear, the movable outer gear wheel exhibiting the internal toothing and constituting the propulsion wheel, and an electric motor for driving the propulsion wheel via the gear system.

11. The propulsion module of claim 10, wherein the electric motor comprises a pinion.

12. The propulsion module of claim 10, wherein the electric motor is a brushless motor having a longitudinal axis perpendicular to an axis of rotation of the propulsion wheel.

13. The propulsion module of claim 10, wherein a transmission ratio between the electric motor and the propulsion wheel is higher than 1:50.

14. The propulsion module of claim 10, wherein the eccentric, internally toothed gear system is a cycloid gear including:

a static component with roller housings;

a toothed wheel with roller housings; and eccentric roller pins extending into the roller housings of the static component and into the roller housings of the toothed wheel.

15. The propulsion module of claim 10, wherein the eccentric, internally toothed gear system is a hypocycloid gear including:

a static component with internal cycloid toothing;

an outer propulsion wheel with internal cycloid toothing; and a double cycloid disc in the internal cycloid toothing of the static component and in the internal cycloid toothing of the outer propulsion wheel.

* * * * *